United States Patent [19]

Ono

[11] Patent Number: 4,580,548

[45] Date of Patent: Apr. 8, 1986

[54] GAS-FIRED HEATER VENT SYSTEM

[75] Inventor: Bryan K. Ono, Santa Monica, Calif.

[73] Assignee: Teledyne Industries, Inc., Los Angeles, Calif.

[21] Appl. No.: 678,700

[22] Filed: Dec. 6, 1984

[51] Int. Cl.[4] ..... F23J 11/00

[52] U.S. Cl. ..... 126/307 A

[58] Field of Search ..... 98/48, 66.1, 78, 79, 98/82, 83, 84, 119; 126/85 B, 307 R, 307 A, 350 R

[56] References Cited

U.S. PATENT DOCUMENTS

| | | | |
|---|---|---|---|
| 1,928,822 | 10/1933 | Schmidt | 126/307 A X |
| 2,030,825 | 2/1936 | Pembroke | 126/307 A |
| 2,057,154 | 10/1936 | Lonergan | 126/307 A |
| 2,604,887 | 7/1952 | Ziph | 126/307 A |
| 3,797,477 | 3/1974 | Ramey | 126/307 A |

FOREIGN PATENT DOCUMENTS

| | | | |
|---|---|---|---|
| 52-14248 | 2/1977 | Japan | 126/85 B |

*Primary Examiner*—Harold Joyce
*Attorney, Agent, or Firm*—Reagin & King

[57] ABSTRACT

A vent system for a gas fired swimming pool heater is disclosed in which replacement of three components is all that is required to change the heater vent to one for use with outdoor installed heaters to one for use with indoor installed heaters. The parts replacement is sufficiently simple to enable unskilled purchasers of the system to effect the changeover.

5 Claims, 7 Drawing Figures

GAS-FIRED HEATER VENT SYSTEM

BACKGROUND OF THE INVENTION

This invention relates to heater vent systems and, more particularly, to a vent system for use with a residential gas-fired swimming pool heater which may be installed indoors or outdoors.

Over the years, a wide variety of gas-fired heaters have been developed for heating the water in residential swimming pools. Some of these heaters are designed for use outdoors, while others are designed for use indoors.

The vent design criteria is significantly different for indoor and outdoor heater installations. For example, in outdoor installations, the vent system must allow for proper heater combustion even under adverse weather conditions such as high winds and rain. Prior art outdoor heaters generally employ a vent cap mounted on the upper end of a vertical vent pipe to disperse the products of heater combustion into the surrounding air.

Prior art indoor heaters require a vent system which will allow for proper heater combustion under such adverse conditions as a severe downdraft and a blocked vent outlet. Prior art indoor heaters generally employ a drafthood mounted on the upper end of a vertical vent pipe to perform the venting function.

The differences in vent systems for indoor and outdoor installations has resulted in the proliferation of heaters designed specifically for indoor or outdoor installations.

It is an object of the present invention to provide an improved vent system for gas-fired heaters.

It is another object of the present invention to provide a vent system which can be used to configure a gas-fired heater for either indoor or outdoor installation.

It is yet another object of the present invention to provide a vent system which may be easily modified by an unskilled person to configure a gas fired heater for either indoor or outdoor installation.

SUMMARY OF THE INVENTION

The foregoing and other objects of the invention are accomplished by providing a vent system for a gas-fired swimming pool heater which includes a first pan-shaped cowling having an opening in its top surface and which is spaced apart above the top surface of the heater. A first sleeve which is employed when the heater is to be installed outdoors, fits around the vent opening and projects through the cowling opening. Similarly, a second sleeve which is also employed when the heater is to be installed outdoors, fits around both the cowling opening and the upper portion of the first sleeve.

A second pan-shaped cowling is provided which has a central opening and two louvered side openings formed in the top surface thereof.

A wind deflector plate, which is employed when the heater is to be installed outdoors, has a third opening therethrough and is detachably fastened to the bottom of the second cowling so that the third opening is axially aligned with the central opening of the second cowling. Threaded spacers are provided for detachably supporting the second cowling spaced-apart above the first cowling, in which position the top of the first sleeve fits around the third opening.

A cover plate which is employed when the heater is to be installed outdoors is detachably fastened to the second cowling to cover the central opening.

A down draft diverter assembly is provided which includes a lower body in the form of a sleeve having substantially the same diameter as the first sleeve, an upper body in the form of a sleeve having substantially the same diameter as the second sleeve and which is fastened on top of the lower body, and an inverted cone-shaped diverter element which is centrally fastened within the upper body. The assembly is employed when the heater is to be installed indoors, by substituting the assembly in place of the first and second sleeves, whereby the bottom of the lower body of the assembly fits around the heater vent opening, and the bottom of the upper body fits around the opening in the first cowling.

A second cover plate having a fourth opening is also employed when the heater is to be installed indoors by substituting the second cover plate for the first cover plate.

Also included in the vent system of the present invention is a hood having a generally dome-shaped body which terminates at its bottom in a mounting plate and terminates at its top in a sleeved opening. The hood is employed when the heater is to be installed indoors by substituting the hood for the wind deflector plate, whereby the mounting plate is detachably fastened to the bottom of the second cowling, and the sleeved opening extends through both the central opening of the second cowling and the fourth opening in the second cover plate.

DESCRIPTION OF THE PREFERRED EMBODIMENT

Figure 1:
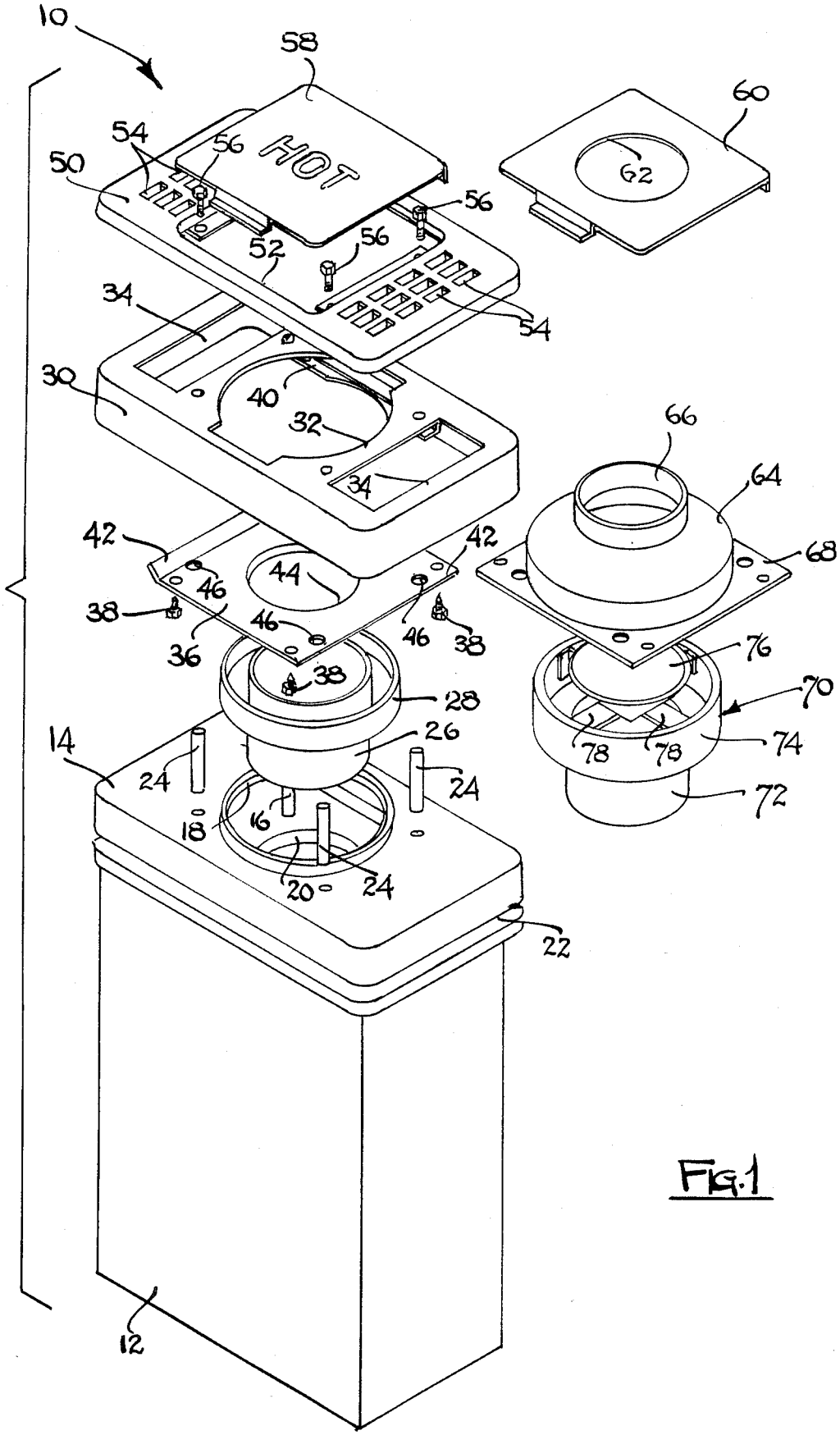
FIG. 1 is an exploded perspective view of a gas-fired heater vent system constructed in accordance with the teachings of the present invention and showing the interchangable parts which convert the heater vent system for use in either indoor or outdoor installations.
Figure 2:
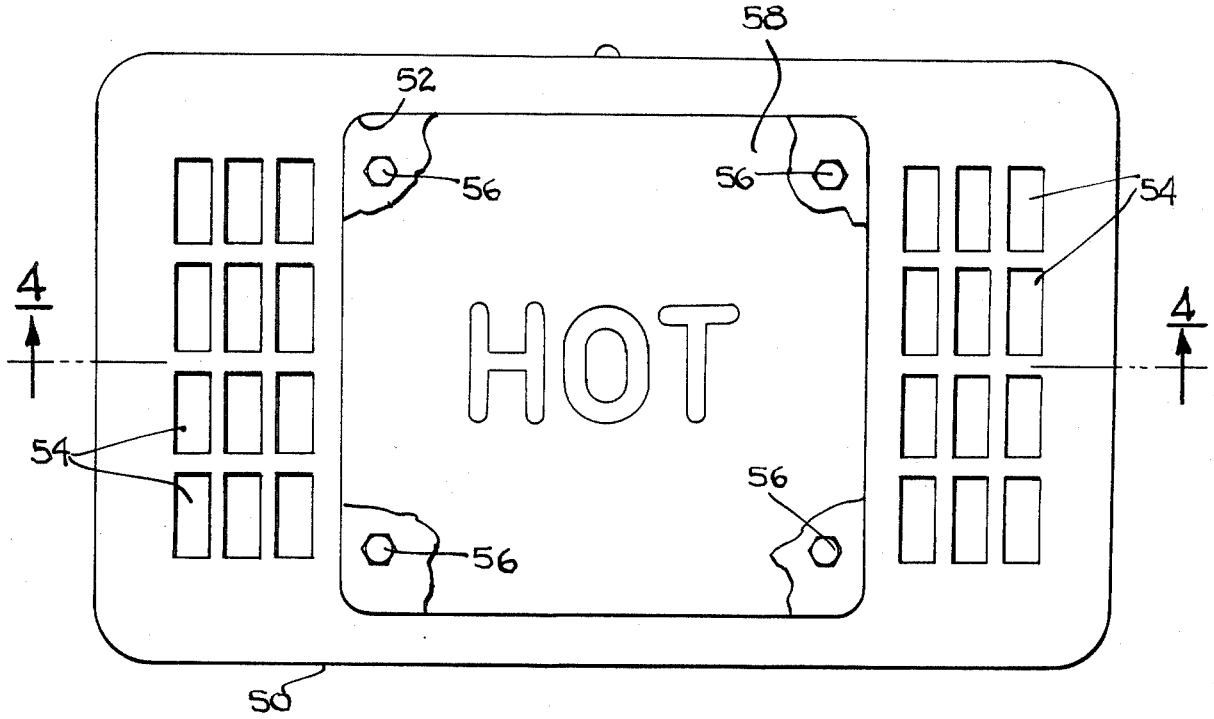
FIG. 2 is a top view of the vent system of FIG. 1 when assembled for outdoor heater installations.
Figure 3:
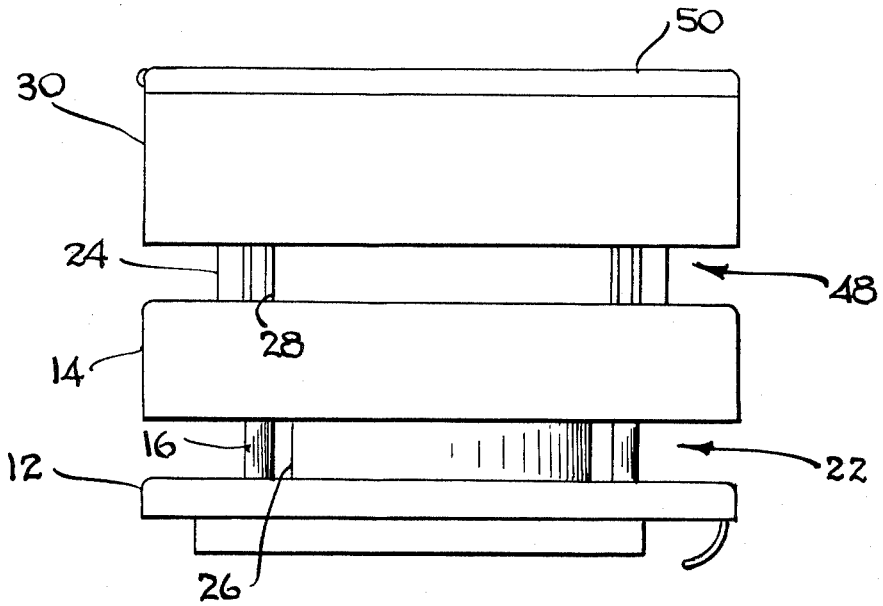
FIG. 3 is an end view of the vent system of FIG. 1 when assembled for outdoor heater installations.

FIG. 1 is an exploded perspective view of the vent system 10 of the present invention. The system 10 is designed to properly vent a gas-fired swimming pool heater 12 when the heater 12 is used in indoor or outdoor installations.

For outdoor heater installations, the vent system 10 is configured as follows. A generally pan-shaped lower cowling 14 is mounted above the top of the heater 12 using spacers 16. The cowling 14 is provided with a sleeved opening 18 which is positioned above a sleeved vent opening 20 in the top of the heater. The cowling 14 is spaced apart from the heater top to form an annular opening 22 around the periphery of the heater 12. Threaded spacers 24 project from the top surface of the cowling 14 and are used to mount additional vent system components as described above.

A first cylindrical sleeve 26 is provided which fits around the vent opening 20 and projects upward through the opening 18. A second cylindrical sleeve 28 fits around the opening 18 and surrounds the upper end of the sleeve 26.

A second pan-shaped cowling 30 is provided which has a central opening 32 and two side openings 34 provided in its top surface. A wind deflector plate 36 is fastened across the bottom of the cowling 30 using four sheet metal screws 38 which engage with holes provided in brackets 40 affixed to the cowling 30. The deflector plate 36 has angled ends 42, an opening 44 which is aligned below the opening 32, and clearance holes 46 to accommodate the spacers 24.

Figure 4:
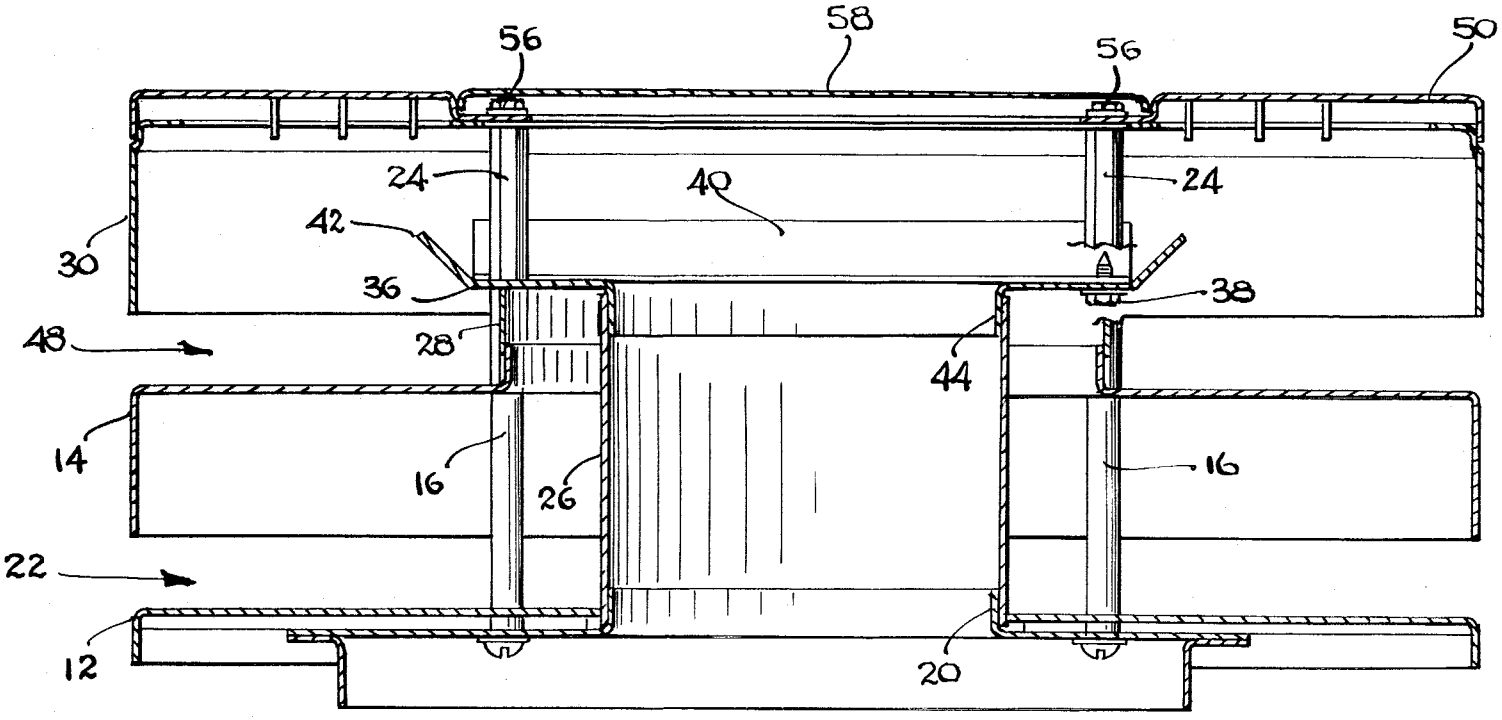
FIG. 4 is a side view, in cross section taken along the line 4—4 of FIG. 2, of the vent system of FIG. 1 when assembled for outdoor heater installations.

Referring to the cross-sectional view of the assembled vent system in FIG. 4, in addition to FIG. 1, it may be seen that the cowling 30, with the plate 36 assembled to it, is fitted over the spacers 24, whereby the cowling 30 is spaced apart above the cowling 14 to form an annular opening 48. In this position, the sleeved opening 44 in the plate 36 fits around the top of the sleeve 26.

A top panel 50 is provided which fits on top of the cowling 30. The panel 50 includes a generally rectangular central opening 52 and two louvered sets of side openings 54. Screws 56 pass through openings in the panel 50 and the cowling 30 and fasten to the threaded spacers 24 to secure the elements 26, 28, 30 and 50 to the heater 12. A top plate 58 snaps into the panel 50 and serves to close the opening 52.

The vent assembly described above is designed to properly disperse flue products and to support proper combustion of the heater in a variety of adverse weather conditions with the heater installed outdoors. Under normal weather conditions, the exhaust from the vent opening 20 in the top of the heater 12 is dispersed into the air through the louvered openings 54. In the instance of a severe downdraft, the exhaust exits through the annular opening 48. In the instance of a severe side wind, the exhaust can still exit via the openings 54 and 48 of the downwind side of the heater 12.

The vent assembly described above for outdoor heater installations can be converted to a vent assembly for indoor heater installations by the simple replacement of three components, as follows. Referring to FIG. 1, the top plate 58 is snapped out of the cowling 50 and is replaced by a second snap-in top plate 60.

The deflection plate 36 is replaced by a down-draft diverter hood 64 having a generally dome-shaped body. The hood 64 terminates at its top in a sleeved opening 66 and terminates at its bottom in a mounting plate 68. The plate 68 is used to mount the hood 64 to the cowling 30 using the four screws 38 and the brackets 40 in a manner analogous to the mounting of the plate 36.

The sleeves 26 and 28 are replaced by a down-draft diverter assembly 70. The assembly 70 includes a lower body in the shape of a cylindrical sleeve 72 having dimensions similar to the sleeve 26, and an upper body in the shape of a cylindrical sleeve 74 having dimensions similar to the sleeve 28. An inverted cone-shaped diverter element 76 is supported within the body 74 using radial ribs 78.

Figure 5:
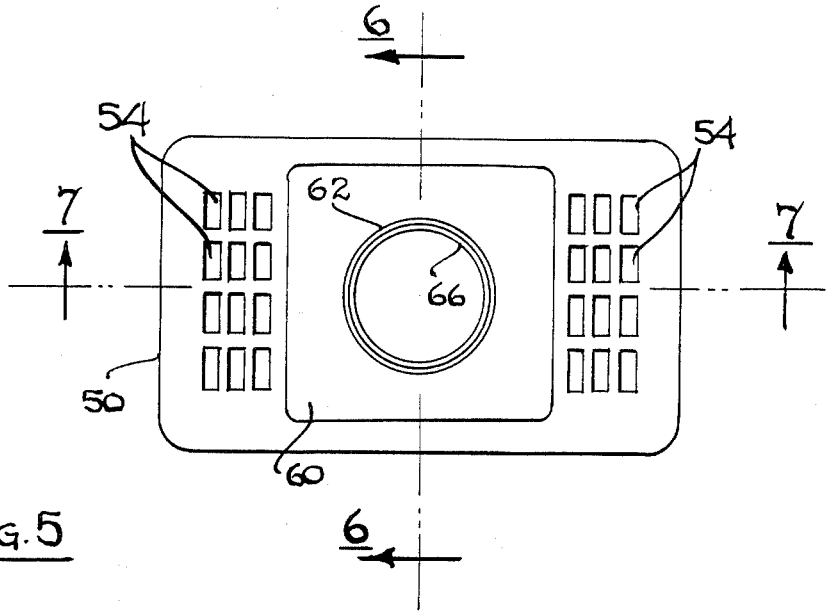
FIG. 5 is a top view of the vent system of FIG. 1 when assembled for indoor heater installations.
Figure 6:
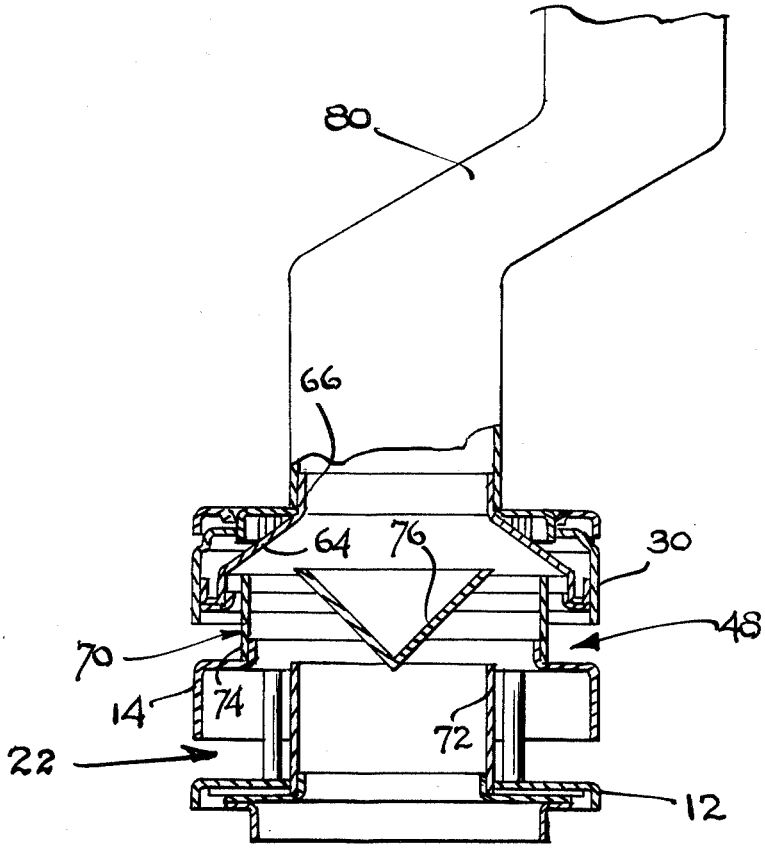
FIG. 6 is a vertical cross-section taken along the line 6—6 of FIG. 5, of the vent system of FIG. 1 when assembled for indoor heater installations.
Figure 7:
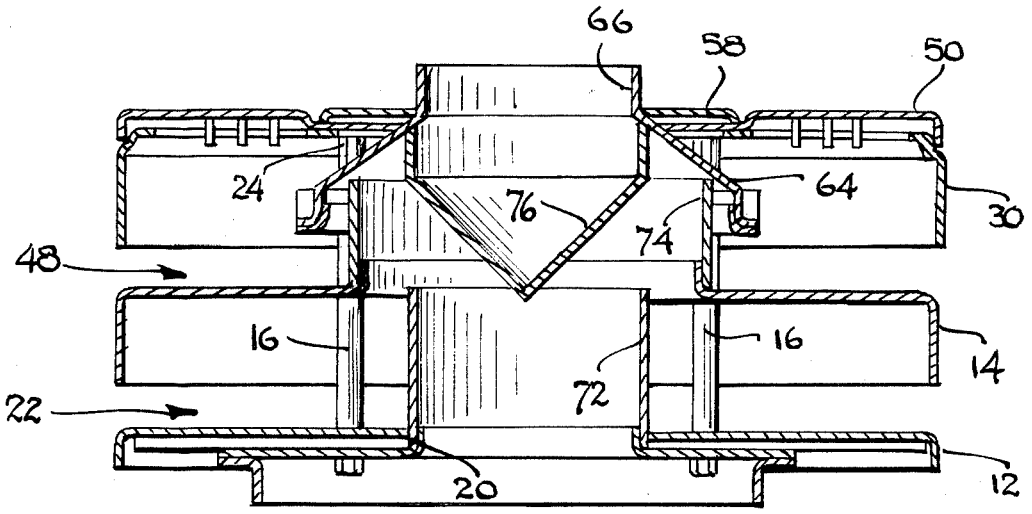
FIG. 7 is a vertical cross-section taken along the line 7—7 of FIG. 5, of the vent system of FIG. 1 when assembled for indoor heater installations.

The sleeve 72 of the diverter assembly 70 is placed around the vent opening 20 of the heater 12 in place of the sleeve 26. In this position, the sleeve 74 of the assembly 70 fits around the opening 18 in the cowling 14 in place of the sleeve 28. When the three components 60, 64, and 70 are substituted into the vent system as described above, the resultant indoor heater vent assembly is as shown in FIGS. 5, 6, and 7. It will be seen that the diverter assembly 70 fits underneath the diverter hood 64, the sleeved opening 66 of which projects through the opening 62 in the top plate 60. The opening 66 communicates with an external vent pipe 80, such as shown in FIG. 6, which carries the combustion gases outdoors.

The vent assembly described above is designed to properly disperse flue products and to support proper combustion of the heater in a variety of adverse conditions with the heater installed indoors. Under normal conditions, the exhaust from the vent opening 20 in the top of the heater 12 rises up and around the diverter cone 76 and exits through the vent pipe 80. The exhaust draws air through openings 22 and 48. The air mixes with and dilutes the flue gases. In the event of a severe downdraft, the downdraft is diverted by the cone 76, causing the exhaust to exit via the annular openings 22 and 48. These openings also serve to vent the heater in the event the outlet of the pipe 80 is obstructed.

From the above description of the vent system 10 of the present invention, it will be appreciated that conversion of the system for indoor or outdoor heater installations is sufficiently simple so that it may be readily accomplished by unskilled purchasers of the heater 12. Accordingly, there is no need to manufacture or stock separate heaters designed for indoor and outdoor installation. In view of the present invention, a single heater may now be constructed which can be adapted by the purchaser for indoor or outdoor installation.

While there has been shown and described a preferred embodiment of the invention, it is to be understood that various other adaptions and modifications may be made within the spirit and scope of the invention. It is thus intended that the invention be limited in scope only by the appended claims.

What is claimed is:

1. A vent system for gas-fired swimming pool heater having a vent opening in the top surface thereof, comprising:

a first pan-shaped cowling having a second opening larger than the vent opening in its top surface and spaced apart above the vent opening in the top surface of the heater;

a first sleeve which is employed when the heater is to be installed outdoors and which fits around the vent opening and projects through the second opening;

a second sleeve which is employed when the heater is to be installed outdoors and which fits around the second opening and the upper portion of the first sleeve;

a second pan-shaped cowling having a central opening and two louvered side openings formed in the top surface thereof;

a wind deflector plate which is employed when the heater is to be installed outdoors, the plate having a third opening therethrough and detachably fastened to the bottom of the second cowling so that the third opening is axially aligned with the central opening of the second cowling;

means for detachably supporting the second cowling spaced-apart above the first cowling, where the top of the first sleeve fits around the third opening;

a cover plate which is employed when the heater is to be installed outdoors and which is detachably fastened to the second cowling to cover the central opening;

a down draft diverter assembly which includes a lower body in the form of a sleeve having substantially the same diameter as the first sleeve, an upper body in the form of a sleeve having substantially the same diameter as the second sleeve and which is fastened on top of the lower body, and an inverted cone-shaped diverter element which is centrally fastened within the upper body, the assembly being employed when the heater is to be installed indoors, by substituting the assembly in place of the first and second sleeves, whereby the bottom of the lower body of the assembly fits around the heater vent opening, and the bottom of the upper body fits around the second opening in the first cowling;

a second cover plate having a fourth opening and being employed when the heater is to be installed indoors by substituting the second cover plate for the first cover plate; and a hood having a generally dome-shaped body which terminates at its bottom in a mounting plate and terminates at its top in a sleeved opening, the hood being employed when the heater is to be installed indoors by substituting the hood for the wind deflector plate, whereby the mounting plate is detachably fastened to the bottom of the second cowling, and the sleeved opening extends through both the central opening of the second cowling and the fourth opening in the second cover plate.

2. A vent system for a gas-fired swimming pool heater having a vent opening in the top surface thereof, comprising:

a first pan-shaped cowling having a second opening larger than the vent opening in its top surface and spaced apart above the vent opening in the top surface of the heater;

a first sleeve which is employed when the heater is to be installed outdoors and which fits around the vent opening and projects through the second opening;

a second sleeve which is employed when the heater is to be installed outdoors and which fits around the second opening and the upper portion of the first sleeve;

a second pan-shaped cowling having a central opening and two louvered side openings formed in the top surface thereof;

a wind deflector plate which is employed when the heater is to be installed outdoors, the plate having a third opening therethrough and detachably fastened to the bottom of the second cowling so that the third opening is axially aligned with the central opening of the second cowling;

means for detachably supporting the second cowling spaced-apart above the first cowling, where the top of the first sleeve fits around the third opening; and a cover plate which is employed when the heater is to be installed outdoors and which is detachably fastened to the second cowling to cover the central opening.

3. The vent system of claim 2 further including:

a down draft diverter assembly which includes a lower body in the form of a sleeve having substantially the same diameter as the first sleeve, an upper body in the form of a sleeve having substantially the same diameter as the second sleeve and which is fastened on top of the lower body, and an inverted cone-shaped diverter element which is centrally fastened within the upper body, the assembly being employed when the heater is to be installed indoors, by substituting the assembly in place of the first and second sleeves, whereby the bottom of the lower body of the assembly fits around the heater vent opening, and the bottom of the upper body fits around the second opening in the first cowling;

a second cover plate having a fourth opening and being employed when the heater is to be installed indoors by substituting the second cover plate for the first cover plate; and a hood having a generally dome-shaped body which terminates at its bottom in a mounting plate and terminates at its top in a sleeved opening, the hood being employed when the heater is to be installed indoors by substituting the hood for the wind deflector plate, whereby the mounting plate is detachably fastened to the bottom of the second cowling, and the sleeved opening extends through both the central opening of the second cowling and the fourth opening in the second cover plate.

4. A vent system for a gas-fired swimming pool heater having a vent opening in the top surface thereof, comprising:

a first pan shaped cowling having a second opening larger than the vent opening in its top surface and spaced apart above the vent opening in the top surface of the heater;

a down draft diverter assembly which includes a lower body in the form of a first sleeve, an upper body in the form of a second sleeve which is fastened on top of the lower body, and an inverted cone-shaped diverter element which is centrally fastened within the upper body, the assembly being employed when the heater is to be installed indoors, where the bottom of the lower body of the assembly fits around the heater vent opening, and the bottom of the upper body fit around the second opening in the first cowling;

a second pan-shaped cowling having a central opening and two louvered side openings formed in the top surface thereof;

a cover plate having a third opening and which is employed when the heater is to be installed indoors by detachably fastening it to the second cowling so that the third opening is aligned with the central opening; and a hood having a generally dome-shaped body which terminates at its bottom in a mounting plate and terminates at its top in a sleeved opening, the hood being employed when the heater is to be installed indoors by detachably fastening the mounting plate to the bottom of the second cowling, whereby the sleeved opening extends through the central opening of the second cowling and the third opening in the cover plate.

5. The vent system of claim 5 further including:

third and fourth sleeves which are employed when the heater is to be installed outdoors by substituting the sleeves for the down draft diverter assembly, where the third sleeve fits around the vent opening and projects through the second opening, and the fourth sleeve fits around the second opening and the upper portion of the first sleeve;

a wind deflector plate having a fourth opening therethrough which is employed when the heater is to be installed outdoors by substituting the plate for the hood by detachably fastening the plate to the bottom of the second cowling so that the fourth opening is axially aligned with the central opening of the second cowling; and a second cover plate which is employed when the heater is to be installed outdoors by substituting it for the first cover plate so that it covers the central opening.

* * * * *